US010283001B2

(12) United States Patent
Bostick et al.

(10) Patent No.: US 10,283,001 B2
(45) Date of Patent: May 7, 2019

(54) OPTIMIZING REAL-TIME AND PLANNED AIR-TRAFFIC

(71) Applicant: International Business Machines Corporation, Armonk, NY (US)

(72) Inventors: James E. Bostick, Cedar Park, TX (US); Munish Goyal, Yorktown Heights, NY (US); Kimberly G. Starks, Nashville, TN (US); Michael Wendel, Cherry Hill, NJ (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 180 days.

(21) Appl. No.: 15/354,120

(22) Filed: Nov. 17, 2016

(65) Prior Publication Data

US 2018/0137766 A1 May 17, 2018

(51) Int. Cl.

| | |
|---|---|
| ***G08G 5/02*** | (2006.01) |
| ***G08G 5/00*** | (2006.01) |
| ***G06Q 50/30*** | (2012.01) |

(52) U.S. Cl.
CPC ..... *G08G 5/0095* (2013.01); *G06Q 50/30* (2013.01); *G08G 5/02* (2013.01)

(58) Field of Classification Search
CPC ..... G08G 5/0095; G08G 5/02; G06Q 50/30
See application file for complete search history.

(56) References Cited

U.S. PATENT DOCUMENTS

| | | | | |
|---|---|---|---|---|
| 8,700,440 | B1 * | 4/2014 | Ande | G06Q 50/30 705/5 |
| 8,793,038 | B1 | 7/2014 | Schultz et al. | |
| 9,008,892 | B2 | 4/2015 | Bollapragada et al. | |
| 2006/0059024 | A1 | 3/2006 | Bailey et al. | |
| 2006/0155432 | A1 | 7/2006 | Brown | |
| 2009/0157438 | A1 | 6/2009 | Chu et al. | |
| 2016/0335567 | A1 * | 11/2016 | Petersen | G06Q 10/025 |

OTHER PUBLICATIONS

Susan Farley et al., Flight Rescheduling Decisions for Minimizing Passenger Trip Delays, Jan. 2014; DOI 10.3233/IDT-130175.
Daykin; Using real-time data to improve air traffic management, Jul. 2, 2015, http://nats.aero/blog/2015/07/real-time-data-improve-air-traffic-management/.
Pozzi et al; Safety Monitoring in the Age of Big Data, Ninth USA/Europe Air Traffic Management Research and Development Seminar (ATM2011).
Pohl; How Big Data Keeps Planes in the Air, Feb. 19, 2015.

* cited by examiner

*Primary Examiner* — Anne M Antonucci
*Assistant Examiner* — Renee LaRose
(74) *Attorney, Agent, or Firm* — Garg Law Firm, PLLC; Christopher K. McLane

(57) ABSTRACT

An optimization model is selected to reduce a number of passengers adversely affected by a delay of an aircraft. A cascade boundary is determined for a length of the delay, which projects the delay at the plurality of airports. Using the optimization model, a probability curve is computed at an airport from the plurality of airports, which outputs a second length of the delay experienced at the airport responsive to the cascade boundary projecting the delay on the airport. The length is adjusted in the optimization model such that a count of passengers adversely affected by the delay at the airport at the elapse of the second length is minimized. A target system is caused to configure the aircraft to be delayed by the adjusted length.

20 Claims, 7 Drawing Sheets

OPTIMIZING REAL-TIME AND PLANNED AIR-TRAFFIC

TECHNICAL FIELD

The present invention relates generally to a method, system, and computer program product for optimizing various aspects of air-travel. More particularly, the present invention relates to a method, system, and computer program product for optimizing real-time and planned air-traffic.

BACKGROUND

Commercial air-travel is a careful coordination of many participants, process, circumstances, and equipment. Each participant, process, circumstance, equipment, alone or in some combination has the potential to affect some aspect of air-travel. Various aspects of air-travel include the movement of passengers, airplanes, flight crews, ground crews, ground equipment, flight paths, airport facilities, and the like.

Hereinafter, a participant, a process, a circumstance, an equipment, alone or in some combination, is collectively and interchangeably referred to as a "factor". A variety of factors affect air-travel.

For example, bad weather can be a factor that causes flight delays, which cause passenger inconvenience, equipment and crew management problems, air-traffic congestion, and many other issues. As another example, a congested airspace can be another example factor which can cause flight delays, missed connections, congestion of ground handling equipment, and other problems. Pre-flight security processing of passengers and baggage can be another example factor that can cause flight delays, missed flights, passenger dissatisfaction, and many other undesirable effects.

It is generally desirable that an effect of a factor or a combination of factors, on an aspect of air-travel should be optimized. Stated another way, an adverse effect of a factor should be minimized, a desirable aspect should be maximized, or an aspect of air-travel should be selected according to the suitability for a given factor.

For example, if bad weather condition exists in one geographical area, it is generally desirable that the number of passengers that are adversely affected by the bad weather should be minimized. As another example, if fuel price exceeds a threshold, a utilization efficiency of the equipment fleet should be maximized.

SUMMARY

The illustrative embodiments provide a method, system, and computer program product. An embodiment includes a method that selects an optimization model to reduce a number of passengers adversely affected by a delay of an aircraft. The embodiment determines a cascade boundary for a length of the delay, wherein the cascade boundary projects the delay at the plurality of airports. The embodiment computes, using the optimization model, a probability curve at an airport from the plurality of airports, wherein the probability curve outputs a second length of the delay experienced at the airport responsive to the cascade boundary projecting the delay on the airport. The embodiment adjusts in the optimization model the length, to form an adjusted length, such that a count of passengers adversely affected by the delay at the airport at the elapse of the second length is minimized. The embodiment causes a target system to configure the aircraft to be delayed by the adjusted length.

An embodiment includes a computer usable program product. The computer usable program product includes one or more computer-readable storage devices, and program instructions stored on at least one of the one or more storage devices.

An embodiment includes a computer system. The computer system includes one or more processors, one or more computer-readable memories, and one or more computer-readable storage devices, and program instructions stored on at least one of the one or more storage devices for execution by at least one of the one or more processors via at least one of the one or more memories.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of the illustrative embodiments when read in conjunction with the accompanying drawings, wherein:

DETAILED DESCRIPTION

Figure 1:
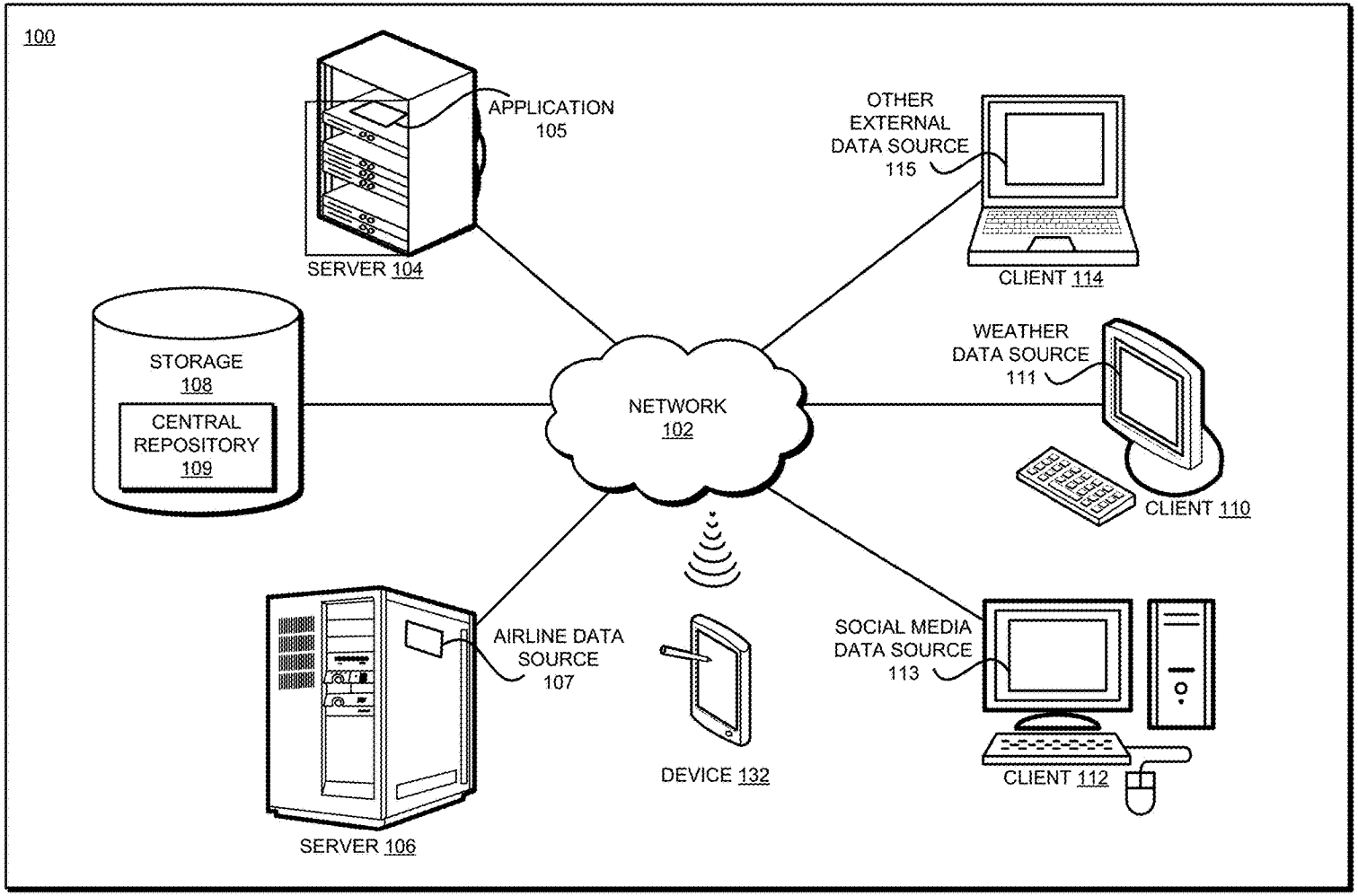
FIG. 1 depicts a block diagram of a network of data processing systems in which illustrative embodiments may be implemented.

The illustrative embodiments recognize that air-traffic operations are performed using a highly distributed environment. Some functions of air-traffic operations are performed by the systems operated by an airline, some other functions of air-traffic operations are performed by the systems operated by an airport, and some other functions of air-traffic operations are performed by the systems operated by an air-traffic control entity. Still other numerous functions of air-traffic operations are performed by the systems operated by one or more other entities such as the Transportation Security Administration, weather forecasters, travel agencies, and many other government agencies and private contractors.

Each entity whose system participate in some aspect of air-travel is responsible for suitable operation, and in some cases, the optimization of their systems. The illustrative embodiments recognize that even when a participating entity has optimized their own system or operation, the effect of such optimization may not translate into a desirable result at some other aspect of overall air-traffic operations. Therefore, the illustrative embodiments recognize that an integrated approach to air-traffic operations optimization is needed where one or more selected aspects can be optimized by considering factors that may or may not be isolated to a single participating entity.

The illustrative embodiments recognize that the presently available tools or solutions do not address these needs or provide adequate solutions for these needs. The illustrative embodiments used to describe the invention generally address and solve the above-described problems and other problems related to optimizing real-time and planned air-traffic.

An embodiment can be implemented as a software application. The application implementing an embodiment can be configured as a modification of an existing air-traffic operation system, as a separate application that operates in conjunction with an existing air-traffic operation system, a standalone application, or some combination thereof.

The illustrative embodiments accept and interpret input from disparate streams of data, apply a ranking or weighing to one or more factors according to their relevance, and compute an optimization solution for one or more aspects of air-traffic operations. Furthermore, some embodiments include machine-learning-based training or retraining of an optimization model to improve the optimization achieved by the model over time based on historical relevance.

The optimizations that can be achieved through the use and adaptations of the illustrative embodiments are too numerous to list or describe exhaustively. Some non-limiting examples of optimizations achievable by using one or more embodiments described herein include— optimizing fuel consumption in a fleet in response to factors such as available fuel quantities and fluctuations in fuel prices;

minimization of adverse effects of air-traffic operations due to factors such as storms and turbulence;

optimization of airplane maintenance using information about factors that are likely to affect the condition of aircrafts, information about such effects gathered over extended periods of time;

optimize equipment selection according to weather factors by using historical knowledge about how various types of airplanes handle certain conditions relative to other types;

minimizing passenger frustration by rearranging the landing order of flights—instance, some flights may have passengers who have tight connections based on current known landing times, while other flights may not. The tightness or shortness of connection time can be used as a factor, which can be ranked and used in determining an order in which flights should be landed or cleared for departure; and optimize staffing—for instance, consider staffing issues that would allow the crew on flight 2828 to continue on if slightly delayed, while a delay to flight 0436 would jeopardize the use of the crew for the next flight based on the regulations. Factors such as regulatory restrictions can be used in deciding an order in which to land or depart flights.

An embodiment collects data, such as in the form of data streams, from a variety of data sources that participate in the air-traffic. Some data may be available in structured form, whereas other data may be in unstructured form. For example, the passengers themselves can be a data source in the air-traffic operation. For example, despite the presence of various entities and systems, factors like security line delays, baggage arrival delays, disruptions at the airport facilities due to construction, and many others, are often shared over social media. A passenger experiencing a problem may share the frustration on social media, making the social media server a data source of social media data stream that can be used in an embodiment.

Different data streams present data differently. Accordingly, to enable consistency and reliability of information, one embodiment pre-processes the data from the data sources to extract usable information in a usable format selected in an implementation-specific manner. For example, the embodiment may process a social media stream through a Natural Language Processing (NLP) engine to extract {subject, predicate, object} triples, perform sentiment analysis, identify factor types and compute their values, and the like.

The pre-processing of a structured data stream may add or drop certain data fields, modify certain values in certain data fields, rearrange data fields, or otherwise manipulate a data structure. For example, weather data may be structured to include weather information by geographical regions. Accordingly, a pre-processing operation may drop the information for certain regions, and extract the wind and icing information for only certain altitudes or flight levels.

As some additional examples of pre-processing, certain aspects of the weather, such as low altitude drizzling precipitation, may not be useful for air-traffic operations. However, turbulence in the air and the potential future turbulence in an area is useful. Similarly, turbulence-related information close to ground level is important for the airport area but not where the flight path uses high altitude flight levels. Furthermore, the pre-processing may normalize the turbulence data, or assign normalized values to turbulence data, e.g., on a scale of 1 to 10.

These examples of pre-processing operations are not intended to be limiting. From this disclosure, those of ordinary skill in the art will be able to conceive many other types of pre-processing that can be applied to a stream of data, and the same are contemplated within the scope of the illustrative embodiments. Furthermore, some data streams may not need any pre-processing, and some data streams may need more than one type of pre-processing within the scope of the illustrative embodiments.

Air-traffic operations require fast responses, which can be hampered by dealing with individual data streams for dynamic data. For fast response times, from the pre-processed data, an embodiment extracts and assimilates specific data items in a central repository. The central repository is a structured knowledge base according to an implementation-specific structure. Particularly, the structure of data stored in the central repository is determined according to the optimizations contemplated in a given implementations of the various embodiments. Assimilation of an extracted data item into the central repository is the process of converting the data item in a form that is consistent with other data items of similar type in the central repository.

As described herein, numerous optimizations are possible using an embodiment and various combinations of data from the central repository. Each optimization is achieved using an optimization model that is constructed to accept certain data items from the central repository as input and produces an instruction or recommendation to cause a change in a target system to achieve the desired optimization. Furthermore, the optimization can be adjusted according to the weighting of the factors involved, as described herein.

Based on the desired optimization, an embodiment selects a suitable optimization model. The embodiment also accepts the weights applicable to control the optimization. The embodiment produces a recommendation, for example, a landing order of aircrafts presently in the air, which when applied to a target system, such as an air-traffic control system, would result in the optimization, such as minimized missed connections for the passengers.

One embodiment produces an instruction corresponding to the recommendation. The instruction when executed on a target system causes the desired optimization to occur.

Depending on the actual outcome of the optimization, e.g., actual number of missed connections resulting from the landing order, an embodiment trains or retrains the selected optimization model. For example, the embodiment may adjust certain optimization controls or weights in the optimization model such that a future recommendation of landing order will further reduce the number of missed connections. As an example, from the retraining for determining the landing order, the embodiment may add weight for the data item that indicates that a possible missed connection is the last flight to that city for the day.

As another example, from the retraining for determining the landing order, the embodiment may adjust the weights to account for an importance associated with a passenger who is likely to miss a connection. As another example, from the retraining for determining the landing order, the embodiment may adjust the weights to account for the number of possible seats left on subsequent flights to accommodate a missed connection.

These examples of optimizing a landing order to minimize missed connections are not intended to be limiting. From this disclosure, those of ordinary skill in the art will be able to conceive many other optimizations and the same are contemplated within the scope of the illustrative embodiments. A detailed example optimization model is described for minimizing passenger delays is described with respect to FIGS. 4-6 herein. Those of ordinary skill in the art will be able to use the example optimization model to construct additional or different models in a similar manner, and such additional or different models are contemplated within the scope of the illustrative embodiments.

The manner of optimizing real-time and planned air-traffic described herein is unavailable in the presently available methods. A method of an embodiment described herein, when implemented to execute on a device or data processing system, comprises substantial advancement of the functionality of that device or data processing system in optimizing one or more aspects of air-traffic operations according to factors occurring in real-time or in a forward-looking fashion.

The illustrative embodiments are described with respect to certain types of participants, process, circumstances, equipment, aspects of air-traffic operations, factors affecting the air-traffic operations, optimizations, models, inputs, processing or pre-processing, devices, data processing systems, environments, components, and applications only as examples. Any specific manifestations of these and other similar artifacts are not intended to be limiting to the invention. Any suitable manifestation of these and other similar artifacts can be selected within the scope of the illustrative embodiments.

Furthermore, the illustrative embodiments may be implemented with respect to any type of data, data source, or access to a data source over a data network. Any type of data storage device may provide the data to an embodiment of the invention, either locally at a data processing system or over a data network, within the scope of the invention. Where an embodiment is described using a mobile device, any type of data storage device suitable for use with the mobile device may provide the data to such embodiment, either locally at the mobile device or over a data network, within the scope of the illustrative embodiments.

The illustrative embodiments are described using specific code, designs, architectures, protocols, layouts, schematics, and tools only as examples and are not limiting to the illustrative embodiments. Furthermore, the illustrative embodiments are described in some instances using particular software, tools, and data processing environments only as an example for the clarity of the description. The illustrative embodiments may be used in conjunction with other comparable or similarly purposed structures, systems, applications, or architectures. For example, other comparable mobile devices, structures, systems, applications, or architectures therefor, may be used in conjunction with such embodiment of the invention within the scope of the invention. An illustrative embodiment may be implemented in hardware, software, or a combination thereof.

The examples in this disclosure are used only for the clarity of the description and are not limiting to the illustrative embodiments. Additional data, operations, actions, tasks, activities, and manipulations will be conceivable from this disclosure and the same are contemplated within the scope of the illustrative embodiments.

Any advantages listed herein are only examples and are not intended to be limiting to the illustrative embodiments. Additional or different advantages may be realized by specific illustrative embodiments. Furthermore, a particular illustrative embodiment may have some, all, or none of the advantages listed above.

Figure 2:
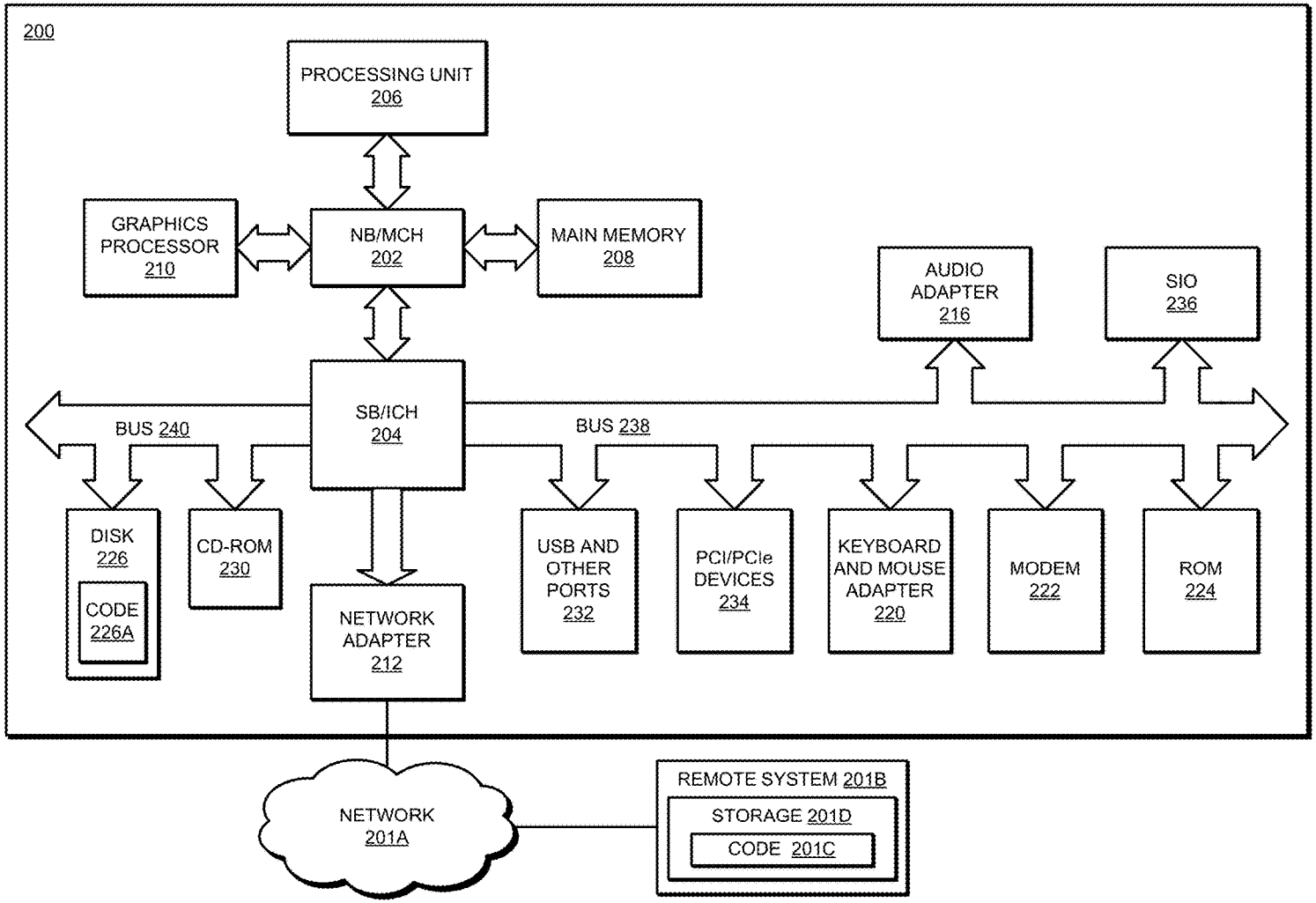
FIG. 2 depicts a block diagram of a data processing system in which illustrative embodiments may be implemented.

With reference to the figures and in particular with reference to FIGS. 1 and 2, these figures are example diagrams of data processing environments in which illustrative embodiments may be implemented. FIGS. 1 and 2 are only examples and are not intended to assert or imply any limitation with regard to the environments in which different embodiments may be implemented. A particular implementation may make many modifications to the depicted environments based on the following description.

FIG. 1 depicts a block diagram of a network of data processing systems in which illustrative embodiments may be implemented. Data processing environment 100 is a network of computers in which the illustrative embodiments may be implemented. Data processing environment 100 includes network 102. Network 102 is the medium used to provide communications links between various devices and computers connected together within data processing environment 100. Network 102 may include connections, such as wire, wireless communication links, or fiber optic cables.

Clients or servers are only example roles of certain data processing systems connected to network 102 and are not intended to exclude other configurations or roles for these data processing systems. Server 104 and server 106 couple to network 102 along with storage unit 108. Software applications may execute on any computer in data processing environment 100. Clients 110, 112, and 114 are also coupled to network 102. A data processing system, such as server 104 or 106, or client 110, 112, or 114 may contain data and may have software applications or software tools executing thereon.

Only as an example, and without implying any limitation to such architecture, FIG. 1 depicts certain components that are usable in an example implementation of an embodiment. For example, servers 104 and 106, and clients 110, 112, 114, are depicted as servers and clients only as example and not to imply a limitation to a client-server architecture. As another example, an embodiment can be distributed across several data processing systems and a data network as shown, whereas another embodiment can be Implemented on a single data processing system within the scope of the illustrative embodiments. Data processing systems 104, 106, 110, 112, and 114 also represent example nodes in a cluster, partitions, and other configurations suitable for implementing an embodiment.

Device 132 is an example of a device described herein. For example, device 132 can take the form of a smartphone, a tablet computer, a laptop computer, client 110 in a stationary or a portable form, a wearable computing device, or any other suitable device. Any software application described as executing in another data processing system in FIG. 1 can be configured to execute in device 132 in a similar manner. Any data or information stored or produced in another data processing system in FIG. 1 can be configured to be stored or produced in device 132 in a similar manner.

Application 105 implements an embodiment described herein. Airline data source 107, weather data source 111, social media data source 113, and other external data source 115 are example data sources that provide data streams as described herein. Central repository 109 stores the extracted and assimilated data items from these streams in a structure, as described herein.

Servers 104 and 106, storage unit 108, and clients 110, 112, and 114, and device 132 may couple to network 102 using wired connections, wireless communication protocols, or other suitable data connectivity. Clients 110, 112, and 114 may be, for example, personal computers or network computers.

In the depicted example, server 104 may provide data, such as boot files, operating system images, and applications to clients 110, 112, and 114. Clients 110, 112, and 114 may be clients to server 104 in this example. Clients 110, 112, 114, or some combination thereof, may include their own data, boot files, operating system images, and applications. Data processing environment 100 may include additional servers, clients, and other devices that are not shown.

In the depicted example, data processing environment 100 may be the Internet. Network 102 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 100 also may be implemented as a number of different types of networks, such as for example, an intranet, a local area network (LAN), or a wide area network (WAN). FIG. 1 is intended as an example, and not as an architectural limitation for the different illustrative embodiments.

Among other uses, data processing environment 100 may be used for implementing a client-server environment in which the illustrative embodiments may be implemented. A client-server environment enables software applications and data to be distributed across a network such that an application functions by using the interactivity between a client data processing system and a server data processing system. Data processing environment 100 may also employ a service oriented architecture where interoperable software components distributed across a network may be packaged together as coherent business applications. Data processing environment 100 may also take the form of a cloud, and employ a cloud computing model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service.

With reference to FIG. 2, this figure depicts a block diagram of a data processing system in which illustrative embodiments may be implemented. Data processing system 200 is an example of a computer, such as servers 104 and 106, or clients 110, 112, and 114 in FIG. 1, or another type of device in which computer usable program code or instructions implementing the processes may be located for the illustrative embodiments.

Data processing system 200 is also representative of a data processing system or a configuration therein, such as data processing system 132 in FIG. 1 in which computer usable program code or instructions implementing the processes of the illustrative embodiments may be located. Data processing system 200 is described as a computer only as an example, without being limited thereto. Implementations in the form of other devices, such as device 132 in FIG. 1, may modify data processing system 200, such as by adding a touch interface, and even eliminate certain depicted components from data processing system 200 without departing from the general description of the operations and functions of data processing system 200 described herein.

In the depicted example, data processing system 200 employs a hub architecture including North Bridge and memory controller hub (NB/MCH) 202 and South Bridge and input/output (I/O) controller hub (SB/ICH) 204. Processing unit 206, main memory 208, and graphics processor 210 are coupled to North Bridge and memory controller hub (NB/MCH) 202. Processing unit 206 may contain one or more processors and may be implemented using one or more heterogeneous processor systems. Processing unit 206 may be a multi-core processor. Graphics processor 210 may be coupled to NB/MCH 202 through an accelerated graphics port (AGP) in certain implementations.

In the depicted example, local area network (LAN) adapter 212 is coupled to South Bridge and I/O controller hub (SB/ICH) 204. Audio adapter 216, keyboard and mouse adapter 220, modem 222, read only memory (ROM) 224, universal serial bus (USB) and other ports 232, and PCI/PCIe devices 234 are coupled to South Bridge and I/O controller hub 204 through bus 238. Hard disk drive (HDD) or solid-state drive (SSD) 226 and CD-ROM 230 are coupled to South Bridge and I/O controller hub 204 through bus 240. PCI/PCIe devices 234 may include, for example, Ethernet adapters, add-in cards, and PC cards for notebook computers. PCI uses a card bus controller, while PCIe does not. ROM 224 may be, for example, a flash binary input/output system (BIOS). Hard disk drive 226 and CD-ROM 230 may use, for example, an integrated drive electronics (IDE), serial advanced technology attachment (SATA) interface, or variants such as external-SATA (eSATA) and micro-SATA (mSATA). A super I/O (SIO) device 236 may be coupled to South Bridge and I/O controller hub (SB/ICH) 204 through bus 238.

Memories, such as main memory 208, ROM 224, or flash memory (not shown), are some examples of computer usable storage devices. Hard disk drive or solid state drive 226, CD-ROM 230, and other similarly usable devices are some examples of computer usable storage devices including a computer usable storage medium.

An operating system runs on processing unit 206. The operating system coordinates and provides control of various components within data processing system 200 in FIG. 2. The operating system may be a commercially available operating system for any type of computing platform, including but not limited to server systems, personal computers, and mobile devices. An object oriented or other type of programming system may operate in conjunction with the operating system and provide calls to the operating system from programs or applications executing on data processing system 200.

Instructions for the operating system, the object-oriented programming system, and applications or programs, such as application 105 in FIG. 1, are located on storage devices, such as in the form of code 226A on hard disk drive 226, and may be loaded into at least one of one or more memories, such as main memory 208, for execution by processing unit 206. The processes of the illustrative embodiments may be performed by processing unit 206 using computer implemented instructions, which may be located in a memory, such as, for example, main memory 208, read only memory 224, or in one or more peripheral devices.

Furthermore, in one case, code 226A may be downloaded over network 201A from remote system 201B, where similar code 201C is stored on a storage device 201D. in another case, code 226A may be downloaded over network 201A to remote system 201B, where downloaded code 201C is stored on a storage device 201D.

The hardware in FIGS. 1-2 may vary depending on the implementation. Other internal hardware or peripheral devices, such as flash memory, equivalent non-volatile memory, or optical disk drives and the like, may be used in addition to or in place of the hardware depicted in FIGS. 1-2. In addition, the processes of the illustrative embodiments may be applied to a multiprocessor data processing system.

In some illustrative examples, data processing system 200 may be a personal digital assistant (PDA), which is generally configured with flash memory to provide non-volatile memory for storing operating system files and/or user-generated data. A bus system may comprise one or more buses, such as a system bus, an I/O bus, and a PCI bus. Of course, the bus system may be implemented using any type of communications fabric or architecture that provides for a transfer of data between different components or devices attached to the fabric or architecture.

A communications unit may include one or more devices used to transmit and receive data, such as a modem or a network adapter. A memory may be, for example, main memory 208 or a cache, such as the cache found in North Bridge and memory controller hub 202. A processing unit may include one or more processors or CPUs.

The depicted examples in FIGS. 1-2 and above-described examples are not meant to imply architectural limitations. For example, data processing system 200 also may be a tablet computer, laptop computer, or telephone device in addition to taking the form of a mobile or wearable device.

Where a computer or data processing system is described as a virtual machine, a virtual device, or a virtual component, the virtual machine, virtual device, or the virtual component operates in the manner of data processing system 200 using virtualized manifestation of some or all components depicted in data processing system 200. For example, in a virtual machine, virtual device, or virtual component, processing unit 206 is manifested as a virtualized instance of all or some number of hardware processing units 206 available in a host data processing system, main memory 208 is manifested as a virtualized instance of all or some portion of main memory 208 that may be available in the host data processing system, and disk 226 is manifested as a virtualized instance of all or some portion of disk 226 that may be available in the host data processing system. The host data processing system in such cases is represented by data processing system 200.

Figure 3:
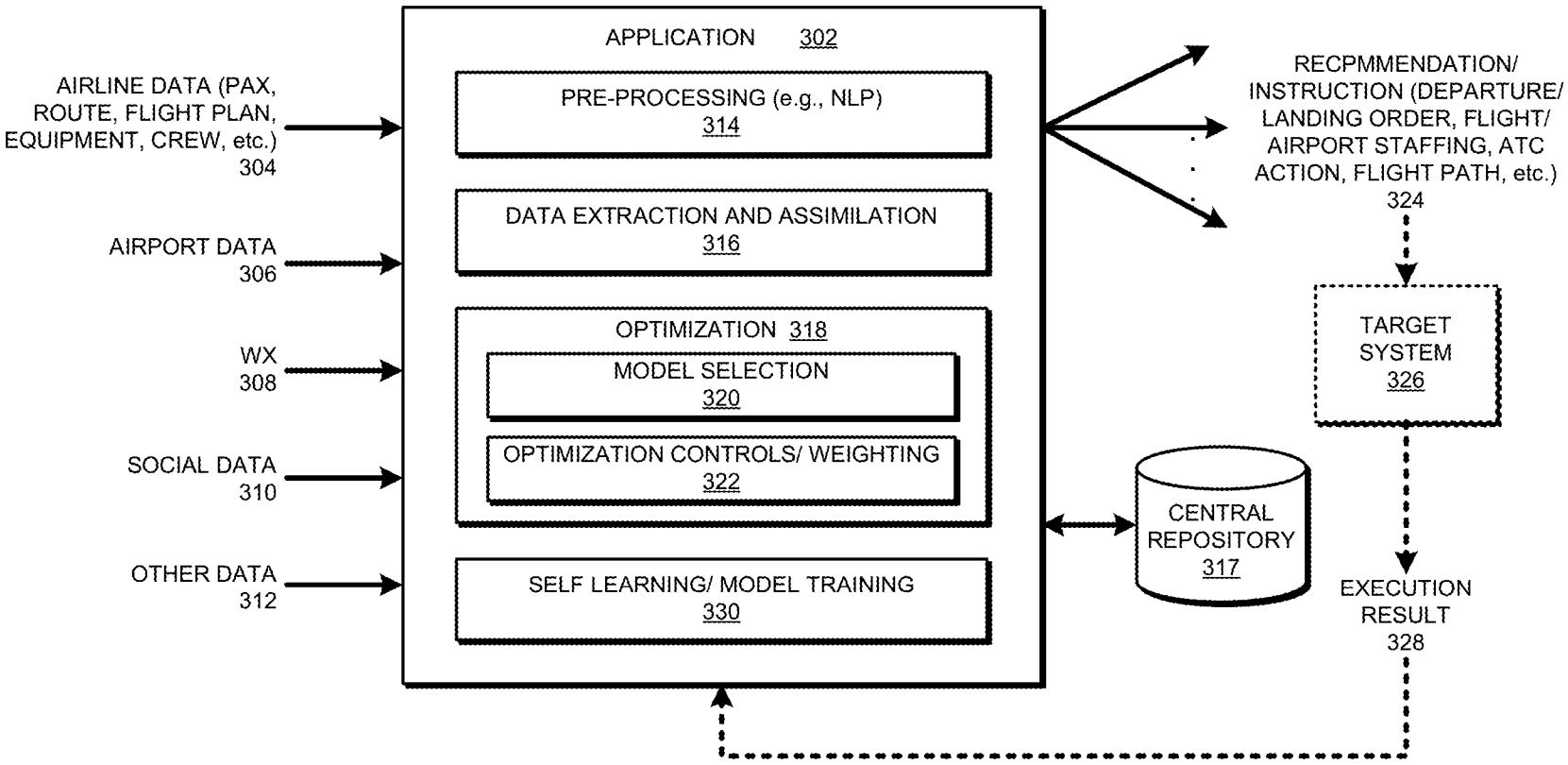
FIG. 3 depicts a block diagram of an example configuration for optimizing real-time and planned air-traffic in accordance with an illustrative embodiment.

With reference to FIG. 3, this figure depicts a block diagram of an example configuration for optimizing real-time and planned air-traffic in accordance with an illustrative embodiment. Application 302 is an example of application 105 in FIG. 1.

Input stream 304 is an example of one or more data streams originating from data source 107 in FIG. 1. For example, an airline system might provide one or more data streams containing data about passengers, routes, flight plans, equipment, crew, and other information usable in an embodiment. An airport system, such as source 115 in FIG. 1, may provide input streams 306 of airport data. Airport data 306 may include information about runway and/or taxiway closures, Instrument Landing System (ILS) maintenance schedule, usable or unusable areas of the airport, and many other types of airport related information.

Weather data source 111 in FIG. 1 may provide weather data stream 308. Social media data source 113 in FIG. 1 may provide social media data 310, e.g., pertaining to a passenger identified in streams 304, relating to an airport or facility identified in stream 306, a geographical area identified in weather data streams 308, and the like. Other data stream 312 may be from any of numerous possible sources, e.g., from a TSA system about security screening delays, etc.

Component 314 pre-processes the data received from streams 304, 306, 308, 310, and 312, as described herein. Component 316 extracts and assimilates the data items from the pre-processed data into central repository 317, as described herein. The operation of components 314 and 316 continues as the data streams come in real-time, and regardless of whether any optimization is being performed at any given time.

Component 318 performs an optimization in a manner described herein. Subcomponent 320 selects an optimization model according to the optimization to be performed. Component 322 adjusts or manipulates the weights or other configured optimization controls to achieve a desired configuration for the selected optimization.

Optimization component 318 performs the optimization according to the suitably configured and weighted model. The optimization produces recommendation 324, and/or optionally an instruction corresponding to recommendation 324. The instruction or recommendation 324, when applied to target system 326 produces actual execution result 328. For example, if recommendation or instruction 324 is to land flights in a certain order, when the ordering is executed in an example target system such as air-traffic control system 326, actual execution result 328 includes an actual number of passengers who missed a connection as a result of the ordering.

Component 330 collects actual execution result 328. Components 314 and 316 populate central repository 317 with data from result 328, if applicable. Component 330 adjusts the model selected using component 320 such that a future instance of result 328 is an improvement over present result 328.

Figure 4:
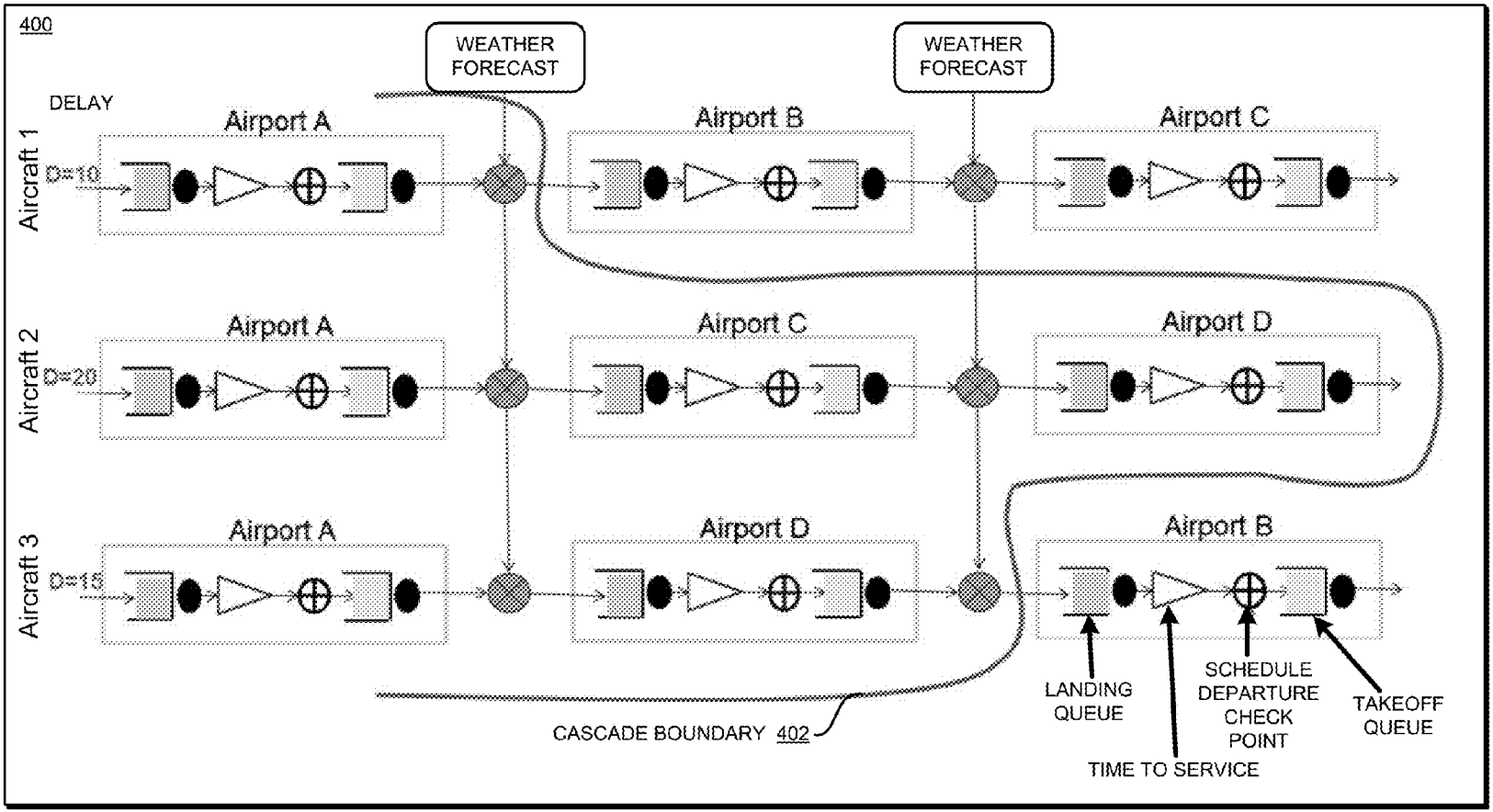
FIG. 4 depicts an example graph of a cascade boundary that can be optimized using an illustrative embodiment.

With reference to FIG. 4, this figure depicts an example graph of a cascade boundary that can be optimized using an illustrative embodiment. Application 302 in FIG. 3 can be used for such an optimization of cascade boundary 402 in graph 400.

Figure 5:
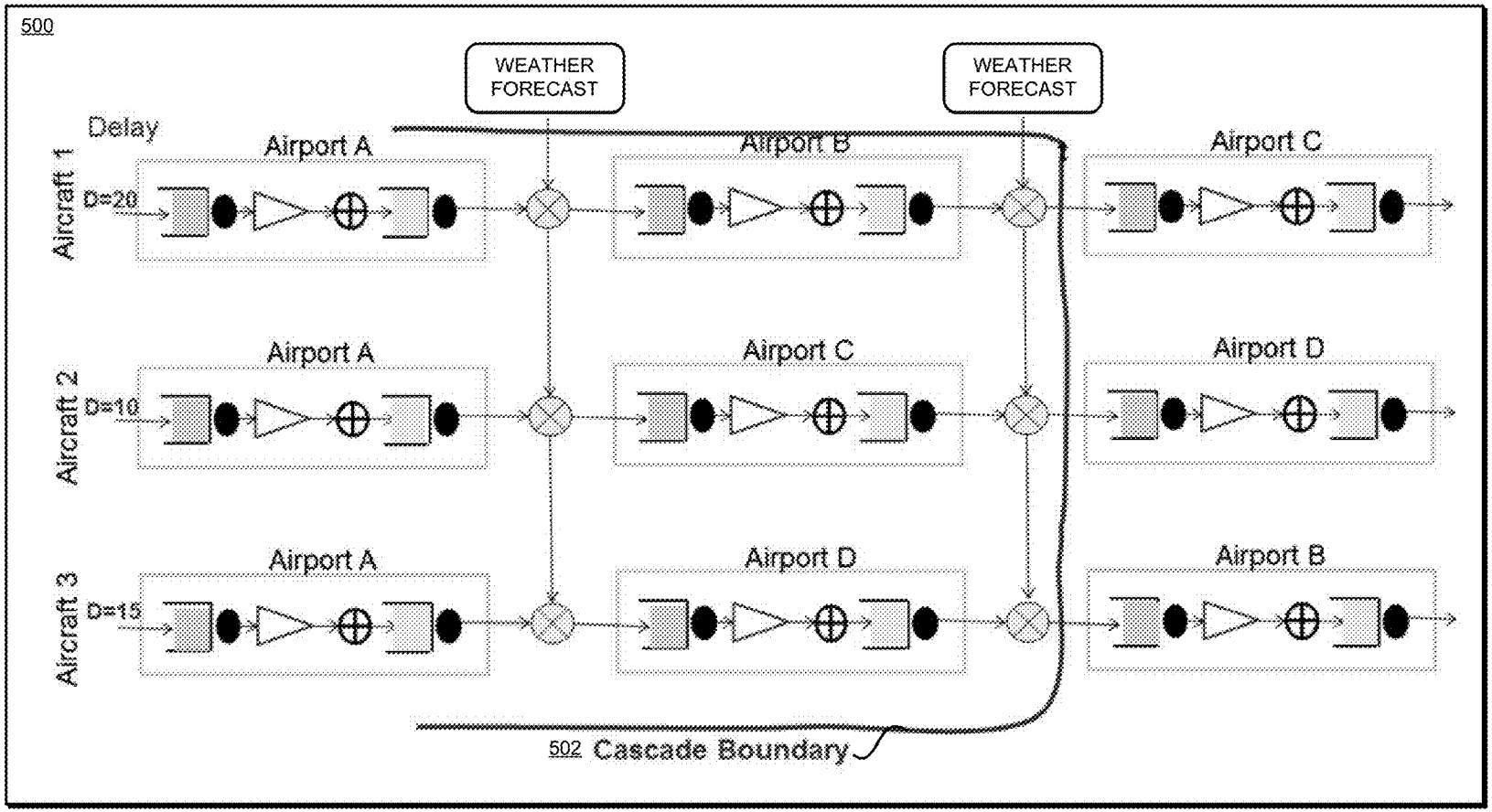
FIG. 5 depicts an example graph with an optimized cascade boundary in accordance with an illustrative embodiment.
Figure 6:
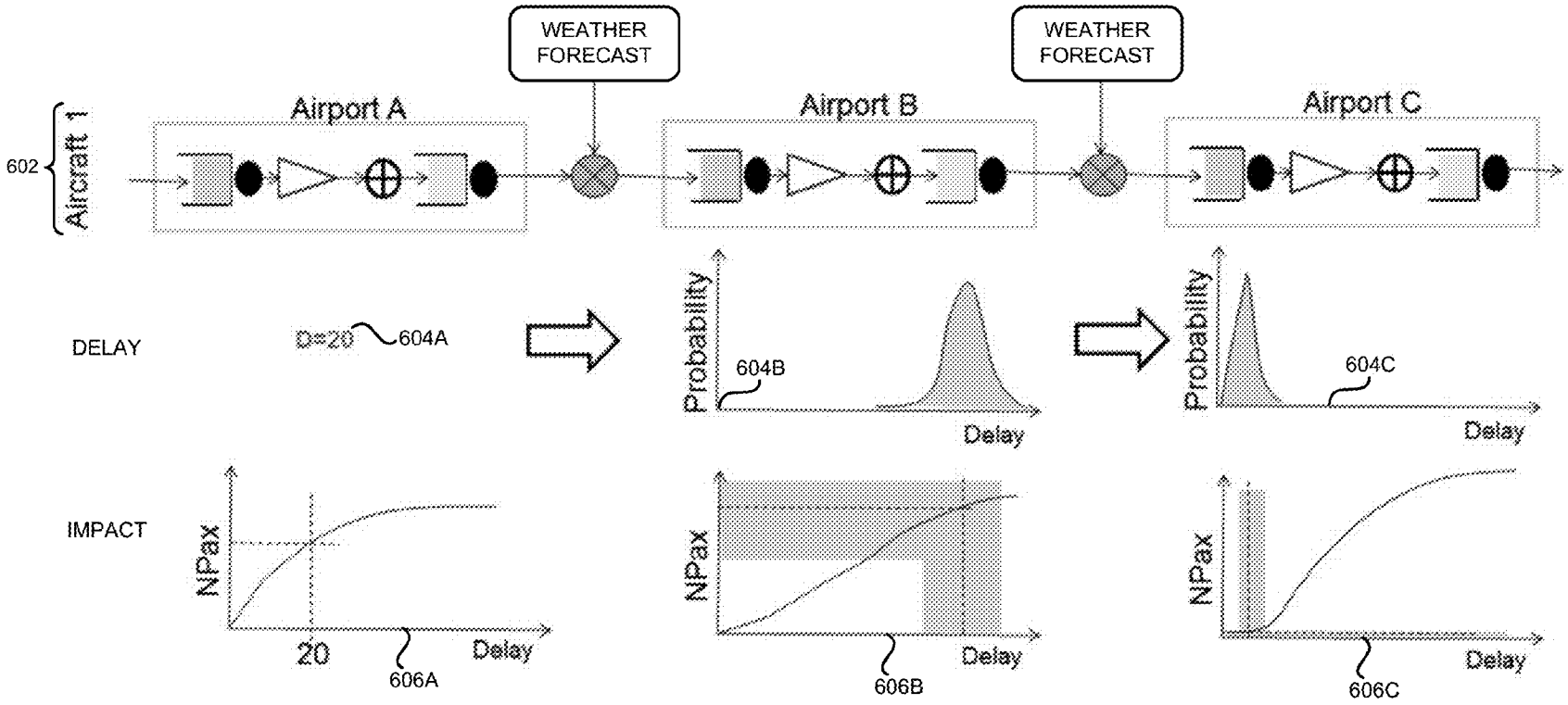
FIG. 6 depicts an example block diagram of an example optimization model computation to determine an optimal cascade boundary in accordance with an illustrative embodiment.

A non-limiting example scenario is described in FIGS. 4-6 for optimizing (minimizing) a number of passengers affected in some manner by a delay in a flight. The information used to describe the problem and the optimization model according to an embodiment will be usable by those of ordinary skill in the art to similarly formulate other optimization problems and models in air-traffic operations. A passenger aircraft typically flies on multiple legs in a pre-defined sequence on a given day. Delay in one leg may impact departures at subsequent legs, resulting in inconvenience to passengers of not only the delayed leg but also of the subsequent legs of that aircraft. This downstream propagation of delay and other adverse effects is called a cascading effect.

This cascading effect may be truncated or disrupted when a delay in one or more previous legs is stopped from causing a delay in a subsequent leg. Thus, disrupting a cascading effect is a desired result because it prevents inconvenience to passengers in the subsequent legs. Where, when, and how to achieve a disruption in a cascading effect is an optimization problem that can be solved using an optimization model in application 302 of FIG. 3.

Particularly, in order to disrupt a cascading effect, some or all of the following data items may be needed—a number of passengers expected to be impacted by a delay at the current leg of a route flown by an aircraft, a number of passengers booked at each leg, passengers who are connecting to other flights or aircrafts at subsequent legs, the connection times of those connections, the scheduled departures times for the connecting flights or aircraft at each leg of the route, any adverse weather conditions expected during subsequent legs of the route, an effect of the adverse weather on the route and/or passengers during the affected legs, the expected landing/takeoff delay at subsequent airports, the new time of arrival and departure of the aircraft at those airports, and the like.

With this setup, consider an example scenario where four airports A, B, C, and D have three aircrafts 1, 2, and 3 servicing them. Each airport has a queue in which an aircraft has to wait to land at that airport. Each airport has an amount of time needed to service an aircraft and make it ready for departure. And once an aircraft passes a scheduled departure checkpoint at the airport, each airport also has a departure or takeoff queue in which an aircraft has to wait for departing the airport.

Aircraft 1 flies a leg from A to B, another leg from B to C, and to a third leg from C thereafter. Aircraft 2 flies a leg from A to C, another leg from C to D, and to a third leg from D thereafter. Aircraft 3 flies a leg from A to D, another leg from D to B, and to a third leg from B thereafter. A leg can be affected by weather, as shown by combining the weather forecast data in each leg.

Now, assume that aircraft 1 has to be delayed by 10 minutes for some reason (D=10 as shown). By the nature of the flight of aircraft 1, that delay does not cascade to the second leg of that aircraft. In other words, the time gaps between leg A-B and leg B-C are sufficiently large to absorb the 10-minute delay in leg A-B. This manner of cascading means that passengers expecting to use aircraft 1 at airports B and C are unaffected by aircraft 1's delay.

Similarly, assume that aircraft 2 has to be delayed by 20 minutes for some reason (D=20 as shown). By the nature of the flight of aircraft 2, that delay cascades to the third leg of that aircraft. In other words, the time gaps between leg A-C, leg C-D, and the leg beyond D are insufficient to absorb the 20-minute delay in leg A-C. This manner of cascading means that passengers expecting to use aircraft 2 at airports C and D are affected by aircraft 2's delay.

Similarly, assume that aircraft 3 has to be delayed by 15 minutes for some reason (D=15 as shown). By the nature of the flight of aircraft 3, that delay cascades to the second leg of that aircraft. In other words, the time gaps between leg A-D and leg D-B are insufficient to absorb the 15-minute delay in leg A-D, but the time gap between leg D-B and the third leg beyond B is sufficient to absorb the cascading delay. This manner of cascading means that passengers expecting to use aircraft 3 at airport D are affected by aircraft 3's delay, but not the passengers expecting to use aircraft 3 at airport B. Thus forms cascade boundary 402 as shown.

With reference to FIG. 5, this figure depicts an example graph with an optimized cascade boundary in accordance with an illustrative embodiment. Graph 500 is an optimized version of graph 400 in FIG. 4. Cascade boundary 502 is an optimized version of cascade boundary 402 in FIG. 4.

Assume that the delay of the aircraft is a controllable factor, such as when the delay is caused by a congested airspace around an airport where the congestion causes the aircrafts to circle—and therefore become delayed—and where without the congestion the aircraft would make their respective scheduled arrivals. An optimization model computes the cascade boundary with different values of delays D for aircrafts 1, 2, and 3. Note that the example scenario with four airports and three aircraft is a trivially simple example. In a real-life scenario, computation of various cascade boundaries is a computationally intensive task with hundreds of airports and thousands of aircrafts. A suitably configured computation algorithm is therefore used in the optimization model to efficiently compute various cascade boundaries and arrive at cascade boundary 502.

According to cascade boundary 502, when aircraft 1 is delayed by 20 minutes, aircraft 2 is delayed by 10 minutes, and aircraft 3 is delayed by 15 minutes, the delays do not cascade beyond the second airports in their respective routes. I.e., the passengers waiting for aircraft 1 at airport C are substantially unaffected by aircraft 1's delay, the passengers waiting for aircraft 2 at airport D are substantially unaffected by aircraft 2's delay, and the passengers waiting for aircraft 3 at airport B are substantially unaffected by aircraft 3's delay.

With reference to FIG. 6, this figure depicts an example block diagram of an example optimization model computation to determine an optimal cascade boundary in accordance with an illustrative embodiment. Scenario 602 is a scenario for aircraft 1 according to graph 500 in FIG. 5.

An example optimization model operates in component 318 in FIG. 3, and optimizes a cascade boundary, thereby optimizing the number of adversely affected passengers, as follows—

For a delay of x minutes as airport A in scenario 602, optimization component 318 of application 302 computes a probability of when a delay will be observed at airport B. For example, if the delay of x minutes occurs midflight in leg A-B, that delay may be entirely observed at airport B, or may be partially recovered before airport B. Assume for the simplification of the description that the optimization component computes graph 604B, which shows the probability of the delay being experienced at airport B. According to graph 604B, entire delay x has the highest probability of being experienced at airport B.

Graph 606B shows a number of passengers adversely affected by delay as delay increases. At delay of x minutes, the optimization component computes the number of passengers affected using graph 606B.

The optimization component uses the optimization model to similarly compute graphs 604C and 606C. As can be seen from the example graphs, the number of affected passengers is high at airport B but insignificant at airport C.

If the delay were to occur at airport A instead of midflight, the optimization component can compute, for probability 604A (100 percent) of delay x at airport A, graph 606A to determine a number of affected passengers at airport A. The total number of affected passengers are the passengers affected at airport A, plus passengers affected at airport B, plus passengers affected at airport C.

In one case, by computing various graphs 604A-C and graphs 606A-C for various values of delay D, the optimization component may determine that delay D=x minimizes the total number of affected passenger. In another case, by computing various graphs 604A-C and graphs 606A-C for various values of delay D, the optimization component determines that delay D for x=20 minimizes the number of affected passenger at airport C.

Different optimization results can similarly be computed by weighting the optimization model differently. For example, if the objective were to minimize the number of affected passengers at airport B, the optimization component might compute a different value of D.

An example optimization model is described below, without implying any limitations of this particular example model on the models usable with the illustrative embodiments—

Decision Variable: Aircraft m arrival delayed at airport A=$D_m$ (A)

Arrivals:

Aircraft m scheduled to arrive at airport X: $SA_m(X)$

Actual departure time of aircraft m at airport X: $EA_m(X)$

Departures:

Aircraft m scheduled to depart from airport X: $SD_m(X)$

Actual departure time of aircraft m at airport X: $ED_m(X)$

Travel Times:

Weather condition for leg X-Y at time t=W(X, Y, t)

Predicted probability distribution of travel time between airport X and airport Y under weather conditions at time of departure for leg X-Y: $\rho(X, Y, W(X, Y, ED_m(X)))$, which includes the amount of time needed for take-off Service time distribution for an aircraft: n;

Predicted probability distribution of landing delay at airport Y under weather conditions at time of departure for leg X-Y: $D_m$ (Y, $ED_m(X)$)

Route=A to X to Y

Scheduled arrival time is represented as SA(airport), scheduled departure time is represented as SD(airport), estimated or predicted arrival time is represented as EA(airport), estimated or predicted departure time is represented as ED(airport)

Cascade Effect of the Delay Decision:

$$ED_m(A)=\max(SA_m(A)+D_m(A)+\nu-SD_m(A),0)$$

$$EA_m(X)=ED_m(A)+\rho(A,X,W(A,X,ED_m(A)))+D_m(A,ED_m(A))$$

$$ED_m(X)=\max(EA_m(X)+\nu-SD_m(X),0)$$

$$EA_m(Y)=ED_m(X)+\rho(X,Y,W(X,Y,ED_m(X)))+D_m(X,ED_m(X))$$

Delay Distribution:

Aircraft m arrival delayed at airport X: $\delta_m$ (X)=max ($EA_m(X)-SA_m(X)$, 0)

Aircraft m arrival delayed at airport Y: $\delta_m$ (Y)=max ($EA_m(Y)-SA_m(Y)$, 0)

A non-limiting example model to evaluate a number of passengers impacted by delay at a given airport is as follows—

Number of PAX booked for leg X-Y=$N_m$ (X,Y)

Connection time for PAX p at airport Y=$C_p$(Y)

If aircraft experiences a delay of $d_m$ (Y)=d arriving at airport Y, number of Passengers who may miss the connection (regrets) is $$R(Y,d)=\Sigma_p \text{ Indicator } \{C_p(Y)-d<\text{Target}(Y)$$

where Target(Y) is minimum time required at airport Y to make a connection.

Furthermore, for other passengers without connections, a desired service level is still needed to ensure social welfare. A non-limiting example model to prioritize landing of aircrafts for maximizing customer welfare is as follows—

Decision Variable: Aircraft m arrival delayed at airport A=$D_m$ (A)

Aggregate PAX Impacted for Route A-X-Y:

$$Z(D_m(A))=\Sigma_d P(\delta_m(X)=R(X,d)+\Sigma_d P(\delta_m(Y)=d)R(Y,d)+\Sigma_d P(D_m(A)=d)R(A,d)$$

Note that decision $D_m$(A) cascades and impacts both $\delta_m$ (X) and $\delta_m$ (Y)

Number of Aircrafts landing at airport A at a time: K

Social Welfare Model:

Select prioritization scheme $\pi$(K) that minimizes the total PAX impacted across all K flights:

Minimize $E(\Sigma_m Z(D_m(A)))$

Subject to $D_m$(A) defined by the prioritization rule $\pi$.

The non-limiting example models described above can be modified, or other models can be constructed to address different operational circumstances.

In this manner, different optimization models can be configured with different variables and weights. The data items collected from various data streams can be applied by the optimization component to the variables under the configured weights to determine optimal values of the variables to achieve a configured outcome. The optimization component recommends these optimal values, or instructs a target system to implement the optimal value, to achieve the configured outcome.

Figure 7:
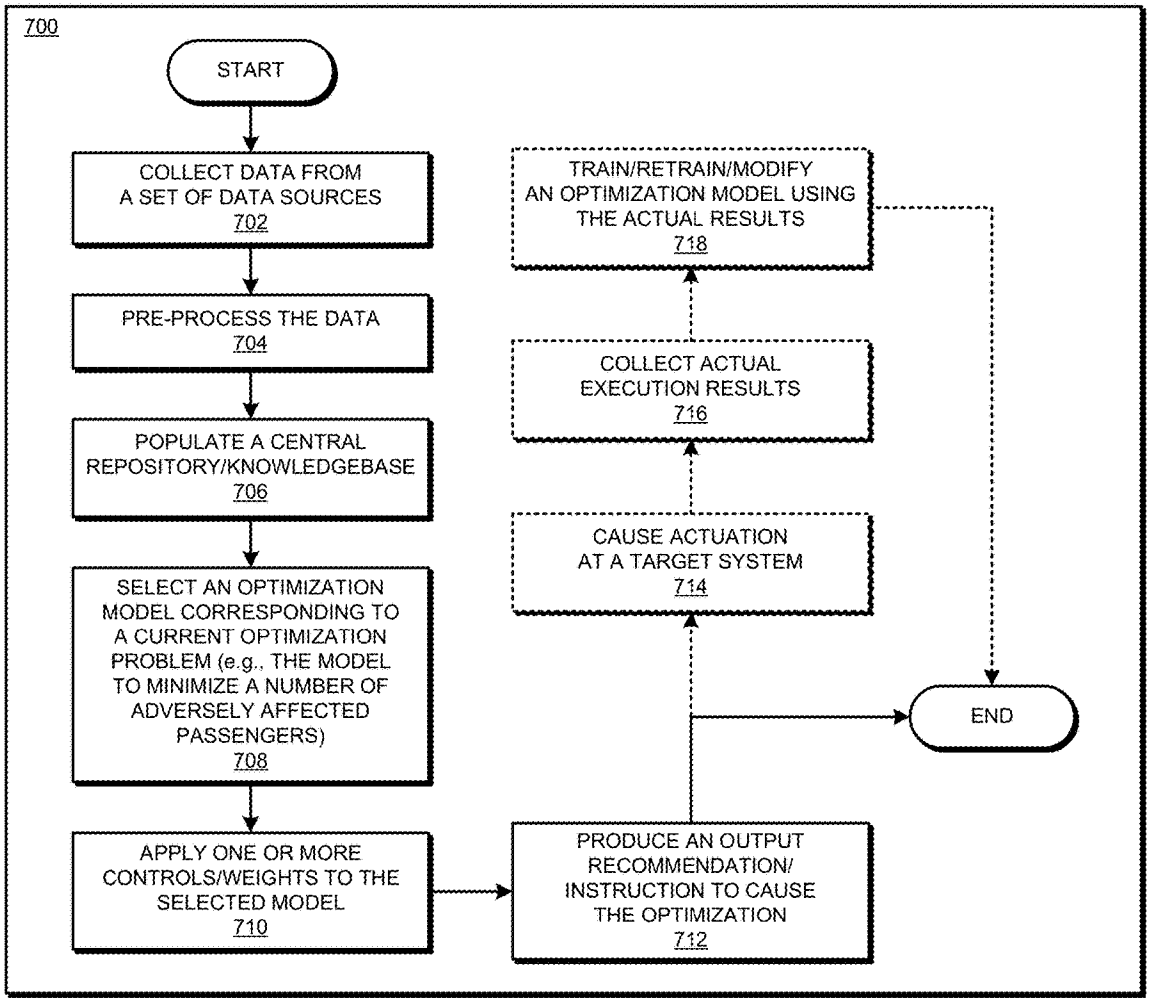
FIG. 7 depicts a flowchart of an example process for optimizing real-time and planned air-traffic in accordance with an illustrative embodiment.

With reference to FIG. 7, this figure depicts a flowchart of an example process for optimizing real-time and planned air-traffic in accordance with an illustrative embodiment. Process 700 can be implemented in application 302 in FIG. 3.

The application collects data from a set of data sources (block 702). The application pre-processes the collected data (block 704). The application populates a central repository with the data items extracted and assimilated from the pre-processed data (block 706).

The application selects an optimization model corresponding to a current optimization problem to be solved, e.g., a model according to FIGS. 4-6 to minimize the number of adversely affected passengers—across all airports on a route or at some specific airport on the route (block 708). The application applies one or more controls or weights to the selected model, e.g., to cause the optimization to occur across all airports or only at some airport according to the example described herein (block 710).

The application produces an output recommendation, an instruction, or both, to cause the optimization (block 712). The application may end process 700 thereafter, or proceed to the model retraining process of blocks 714-718.

In the model retraining process, the application causes an actuation at a target system using the instruction or recommendation produced at block 712 (block 714). The application collects the actual execution result (block 716). The application trains or retrains, or otherwise modify the optimization model using the actual execution result such that a subsequent execution result achieves comparatively better optimization, if possible (block 718). The application ends process 700 thereafter.

Thus, a computer implemented method, system or apparatus, and computer program product are provided in the illustrative embodiments for optimizing real-time and planned air-traffic and other related features, functions, or operations. Where an embodiment or a portion thereof is described with respect to a type of device, the computer implemented method, system or apparatus, the computer program product, or a portion thereof, are adapted or configured for use with a suitable and comparable manifestation of that type of device.

Where an embodiment is described as implemented in an application, the delivery of the application in a Software as a Service (SaaS) model is contemplated within the scope of the illustrative embodiments. In a SaaS model, the capability of the application implementing an embodiment is provided to a user by executing the application in a cloud infrastructure. The user can access the application using a variety of client devices through a thin client interface such as a web browser (e.g., web-based e-mail), or other light-weight client-applications. The user does not manage or control the underlying cloud infrastructure including the network, servers, operating systems, or the storage of the cloud infrastructure. In some cases, the user may not even manage or control the capabilities of the SaaS application. In some other cases, the SaaS implementation of the application may permit a possible exception of limited user-specific application configuration settings.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method comprising:

selecting an optimization model to reduce a number of passengers adversely affected by a delay of an aircraft;

computing, using a processor and a memory, a cascade boundary for a length of the delay, wherein the cascade boundary projects a set of projected results of the delay at each of a plurality of airports;

computing, using the optimization model and using a processor and a memory, a probability curve at an airport from the plurality of airports, wherein the probability curve outputs a probability corresponding to a second length of the delay experienced at the airport responsive to the cascade boundary projecting a projected result of the set of projected results of the delay on the airport;

adjusting in the optimization model the length, to form an adjusted length, such that a count of passengers adversely affected by the delay at the airport at the elapse of the second length is minimized; and causing a target system to configure the aircraft to be delayed by the adjusted length.

2. The method of claim 1, further comprising:

constructing an instruction for the target system, the instruction comprising the adjusted length; and causing the target system to execute the instruction.

3. The method of claim 2, wherein the target system is an air-traffic control system, and wherein causing the target system to execute the instruction causes a set of aircrafts to be reordered for landing such that the aircraft in the set of aircrafts lands after a delay of the adjusted length.

4. The method of claim 1, further comprising:

adjusting, in the optimization model, the delay to a third length, such that a fourth length ends at a second airport when a total of the count at the airport and a second count of passengers at the second airport who are affected by the delay is at a minimum.

5. The method of claim 1, further comprising:

computing, using a second time curve of passengers at the airport, the count of passengers at the airport after the second length of time, wherein the count is a part of the number of passengers.

6. The method of claim 1, wherein the number of passengers is a total number of passengers affected at a plurality of airports, wherein in the total number of passengers is a subset of a set of passengers expecting to use the aircraft at the plurality of airports.

7. The method of claim 1, wherein the number of passengers are at a specific airport, wherein in the number of passengers is a subset of a set of passengers expecting to use the aircraft at the specific airport.

8. The method of claim 1, wherein the length of the delay is a controllable factor prior to an occurrence of the delay.

9. A computer usable program product comprising one or more computer-readable storage mediums, and program instructions stored on at least one of the one or more storage mediums, the stored program instructions when executed by a processor causing operations comprising:

selecting an optimization model to reduce a number of passengers adversely affected by a delay of an aircraft;

computing, using a processor and a memory, a cascade boundary for a length of the delay, wherein the cascade boundary projects a set of projected results of the delay at each of a plurality of airports;

computing, using the optimization model and using a processor and a memory, a probability curve at an airport from the plurality of airports, wherein the probability curve outputs a probability corresponding to a second length of the delay experienced at the airport responsive to the cascade boundary projecting a projected result of the set of projected results of the delay on the airport;

adjusting in the optimization model the length, to form an adjusted length, such that a count of passengers adversely affected by the delay at the airport at the elapse of the second length is minimized; and causing a target system to configure the aircraft to be delayed by the adjusted length.

10. The computer usable program product of claim 9, the stored program instructions when executed by a processor causing operations further comprising:

constructing an instruction for the target system, the instruction comprising the adjusted length; and causing the target system to execute the instruction.

11. The computer usable program product of claim 10, wherein the target system is an air-traffic control system, and wherein causing the target system to execute the instruction causes a set of aircrafts to be reordered for landing such that the aircraft in the set of aircrafts lands after a delay of the adjusted length.

12. The computer usable program product of claim 9, the stored program instructions when executed by a processor causing operations further comprising:

adjusting, in the optimization model, the delay to a third length, such that a fourth length ends at a second airport when a total of the count at the airport and a second count of passengers at the second airport who are affected by the delay is at a minimum.

13. The computer usable program product of claim 9, the stored program instructions when executed by a processor causing operations further comprising:

computing, using a second time curve of passengers at the airport, the count of passengers at the airport after the second length of time, wherein the count is a part of the number of passengers.

14. The computer usable program product of claim 9, wherein the number of passengers is a total number of passengers affected at a plurality of airports, wherein in the total number of passengers is a subset of a set of passengers expecting to use the aircraft at the plurality of airports.

15. The computer usable program product of claim 9, wherein the number of passengers are at a specific airport, wherein in the number of passengers is a subset of a set of passengers expecting to use the aircraft at the specific airport.

16. The computer usable program product of claim 9, wherein the length of the delay is a controllable factor prior to an occurrence of the delay.

17. The computer usable program product of claim 9, wherein the computer usable code is stored in a computer readable storage device in a data processing system, and wherein the computer usable code is transferred over a network from a remote data processing system.

18. The computer usable program product of claim 9, wherein the computer usable code is stored in a computer readable storage device in a server data processing system, and wherein the computer usable code is downloaded over a network to a remote data processing system for use in a computer readable storage device associated with the remote data processing system.

19. A computer system comprising a processor, a memory, and a computer-readable storage medium, and program instructions stored on the storage medium for execution by the processor via the memory, the stored program instructions when executed by the processor causing operations comprising:

selecting an optimization model to reduce a number of passengers adversely affected by a delay of an aircraft;

computing, using a processor and a memory, a cascade boundary for a length of the delay, wherein the cascade boundary projects a set of projected results of the delay at each of a plurality of airports;

computing, using the optimization model and using a processor and a memory, a probability curve at an airport from the plurality of airports, wherein the probability curve outputs a probability corresponding to a second length of the delay experienced at the airport responsive to the cascade boundary projecting a projected result of the set of projected results of the delay on the airport;

adjusting in the optimization model the length, to form an adjusted length, such that a count of passengers adversely affected by the delay at the airport at the elapse of the second length is minimized; and causing a target system to configure the aircraft to be delayed by the adjusted length.

20. The computer system of claim 19, the stored program instructions when executed by a processor causing operations further comprising:

constructing an instruction for the target system, the instruction comprising the adjusted length; and causing the target system to execute the instruction.

* * * * *